US008826533B2

(12) United States Patent
Seifert et al.

(10) Patent No.: US 8,826,533 B2
(45) Date of Patent: Sep. 9, 2014

(54) CRIMP CONNECTION TO ALUMINUM CABLE

(75) Inventors: Kurt P. Seifert, Cortland, OH (US); Lisa L. Flauto, Boardman, OH (US); Jeffrey M. Handel, Warren, OH (US); Masahiro Yoshino, Toyota (JP)

(73) Assignee: Delphi Technologies, Inc., Troy, MI (US)

( * ) Notice: Subject to any disclaimer, the term of this patent is extended or adjusted under 35 U.S.C. 154(b) by 150 days.

(21) Appl. No.: 13/168,309

(22) Filed: Jun. 24, 2011

(65) Prior Publication Data

US 2012/0324727 A1 Dec. 27, 2012

(51) Int. Cl.

| | |
|---|---|
| ***H01R 43/02*** | (2006.01) |
| ***H01R 4/02*** | (2006.01) |
| ***H01R 43/048*** | (2006.01) |
| ***H01R 4/18*** | (2006.01) |
| *H01B 13/00* | (2006.01) |

(52) U.S. Cl.

CPC ..... *H01R 4/187* (2013.01); *H01R 43/048* (2013.01)

USPC ..... 29/857; 29/860; 29/861; 29/863; 29/867; 228/110.1; 228/111; 228/111.5

(58) Field of Classification Search

USPC ..... 29/857, 860, 861, 863, 867; 228/110.1, 228/1.1, 111, 111.5

See application file for complete search history.

(56) References Cited

U.S. PATENT DOCUMENTS

| | | | | |
|---|---|---|---|---|
| 3,978,581 | A * | 9/1976 | Miura | 29/858 |
| 5,495,668 | A * | 3/1996 | Furusawa et al. | 29/874 |
| 6,051,791 | A * | 4/2000 | King | 174/87 |
| 6,573,454 | B2 * | 6/2003 | Fujiwara | 174/74 R |
| 6,958,449 | B1 * | 10/2005 | Ziebart et al. | 174/84 R |
| 7,465,606 | B2 | 12/2008 | DeWys et al. | |
| 7,828,610 | B2 * | 11/2010 | Lehmann et al. | 439/874 |
| 2002/0162683 | A1 * | 11/2002 | Fujiwara | 174/74 R |
| 2007/0068991 | A1 * | 3/2007 | Handel et al. | 228/1.1 |
| 2010/0003867 | A1 * | 1/2010 | Lehmann et al. | 439/874 |
| 2011/0083324 | A1 | 4/2011 | Martauz et al. | |
| 2011/0094797 | A1 * | 4/2011 | Otsuka et al. | 174/84 C |

FOREIGN PATENT DOCUMENTS

| | | | |
|---|---|---|---|
| JP | 09180848 | A * | 7/1997 |
| JP | 2001167821 | A * | 6/2001 |
| JP | 2011081918 | A * | 4/2011 |
| JP | 2011124032 | A * | 6/2011 |

* cited by examiner

*Primary Examiner* — Peter DungBa Vo
*Assistant Examiner* — Kaying Kue
(74) *Attorney, Agent, or Firm* — Robert J. Myers

(57) ABSTRACT

A method to electrically and mechanically connect at least one wire conductor to a terminal includes the steps of cutting and stripping a portion of an insulation outer layer along an end section of the at least one wire conductor to expose a lead of the at least one wire conductor. A further step includes applying a bonding process to the exposed lead to break down oxides disposed on the lead. A further step in the method is crimping the lead having the applied bonding process to the terminal to form a crimp connection connecting the at least one wire conductor to the terminal.

8 Claims, 5 Drawing Sheets

CRIMP CONNECTION TO ALUMINUM CABLE

TECHNICAL FIELD

This invention relates to a crimp connection that attaches a wire conductor to a terminal.

BACKGROUND OF INVENTION

It is known to crimp a wire cable to a terminal.

A cable harness constructed of wire cables formed with aluminum wire core provides a wiring alternative for vehicle manufacturers that allow a vehicle to have decreased mass where the aluminum cable harness is employed. A decrease in the vehicle's mass may result in desired increased fuel economy for the vehicle. A challenge with aluminum wire cables is ensuring robust electrical connections to corresponding terminations. Terminals electrically connect a lead of the aluminum wire cable to electrical components disposed on the vehicle. Undesired oxides disposed on the lead may negatively affect the electrical performance at the lead/terminal interface due to a high resistance connection. Enhanced electrical performance for lead/terminal interface may be attained when undesired oxides are broken down on the lead, so that when the lead and the terminal are connected together, a reliable electrical and mechanical connection may be consummated.

Thus, what is needed is a robust crimp connection that mechanically and electrically connects a lead of a wire conductor to a terminal where a bonding process is performed on the lead to break down oxides prior to the lead being crimped to the terminal.

SUMMARY OF THE INVENTION

In accordance with an embodiment of the invention, a method to electrically and mechanically connect at least one wire conductor to a terminal is presented. The at least one wire conductor is disposed along a longitudinal axis and has an axial length. The at least one wire conductor also includes a metallic wire inner core surrounded by an insulation outer layer. One step in the method is cutting the insulation outer layer along an end section of the wire conductor. Another step in the method is stripping a portion of the insulation outer layer away from the end section to expose a lead of the metallic wire inner core. A further step in the method is applying a bonding process to the lead to break down oxides disposed on the lead. A further step in the method involves crimping the lead that has the applied bonding process to the terminal to form a crimp connection of the lead and the terminal.

These and other advantageous features as disclosed in the embodiments of the present invention will be become apparent from the following brief description of the drawings, detailed description, appended claims and drawings.

BRIEF DESCRIPTION OF THE DRAWINGS

This invention will be further described with reference to the accompanying drawings in which.

DETAILED DESCRIPTION

Figure 1:
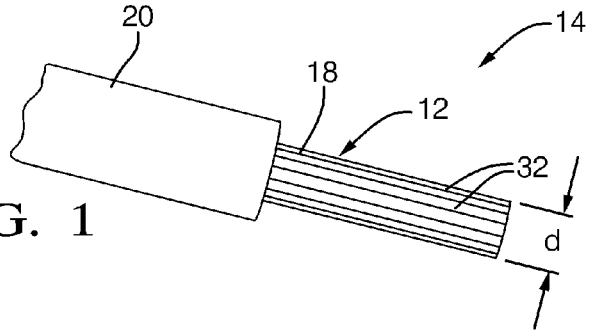
FIG. 1 shows a wire conductor with an exposed lead that contains a plurality of straight individual wire strands.

Insulated copper-based wire conductor has historically been used in automotive wiring. The performance characteristics of copper include high conductivity, good corrosion resistance, and adequate mechanical strength. If the copper wire conductor includes individual wire strands, each copper wire strand has a low resistance in relation to other adjacent copper wire strands ensuring a desired low resistance connection of the copper wire conductor to the terminal. A low resistance connection of the copper wire strands to the terminal generally has an improved electrical operating performance. However, copper and copper-based metals are relatively expensive metals and also have a heavy mass. In contrast, aluminum and aluminum-based metals generally weigh and cost less than copper. However, aluminum has an undesired material characteristic being susceptible to oxide build-up. Aluminum wire conductor that includes individual wire strands may have oxide layer build-up disposed on, or in-between the individual aluminum wire strands. The oxides, if left unabated and undisturbed, may act as a dielectric insulating layer between each of the aluminum wire strands such that a high resistance condition may develop. This high resistance condition may degrade electrical operating performance of the aluminum wire conductor when the wire strands are connected to the terminal. As the size of the wire conductor increases the wire conductor may have an increased amount of wire strands for carrying larger amounts of voltage or current. With an increase in the number of wire strands, a higher percentage of wire strands do not make physical contact with the terminal when the wire conductor and terminal are connected. This undesirably increases the opportunity for poor electrical connection as the inner wire strands in the core surrounding an outer perimeter of wire strands may contain oxide layers that inhibit effective transfer of electrical energy from the inner wire strands to the terminal. Thus, as the number of individual wire strands increase the potential for high resistance connections between the individual wire strands also increases, and the bonding process before constructing the crimp connection becomes more critical.

The following terms used in the specification have the following definitions:

Copper or copper-based material—A copper-based metal or material may be defined as pure copper or a copper alloy where copper is the main metal in the alloy.

Aluminum or aluminum based material—An aluminum-based metal or material may be defined as pure aluminum or an aluminum alloy where aluminum is the main metal in the alloy.

Bonding process—A bonding process is any process or method that allows individual wire strands to bond and/or adhere one-to-another in some manner to produce a low resistance crimp connection between the lead having the applied bonding process and the terminal. The bonding process may include being compacted in the area where the bonding process is applied. A lead is compressed from an original form by an applied pressure in some manner. If the metallic inner wire core is formed of individual wire strands, the wire strands are compacted closer together. As oxides are broken-up or fractured on, and in-between the wire strands of the lead, this leaves fissures of aluminum that may make direct contact to the terminal. Fissures of aluminum may also make direct contact with other wire strands within the metallic inner wire core due to the compaction of the individual wire strands. For example, individual wire strands may be compacted by being press fit together under an applied pressure.

Ultrasonic weld—The ultrasonic weld is a type of bonding process that includes pressure, energy, and amplitude of the energy applied to at least a portion of the lead. When the inner metallic wire core is formed of individual wire strands, the applied ultrasonic weld energy bonds the individual wire strands together such that there is diffusion between aluminum atoms between adjacent wire strands so that the individual wire strands effectively become a single unitary wire strand in the area of the lead covered by the applied ultrasonic weld. The applied ultrasonic weld energy also causes the individual wire strands to vibrate and move in a fashion so that oxides disposed on the wire strands or the adjacent wire strands are broken down, or effectively fractured. After the ultrasonic weld is completed, the area of the lead covered by the ultrasonic weld may exhibit a cross hatch pattern that covers the area due to the sonotrode and anvil tooling used to apply the pressure to apply the ultrasonic weld.

Aspect Ratio—The aspect ratio (AR) is the core crimp width (CCW) divided by the core crimp height (CCH). The AR provides a measure of stability of the crimp connection to provide robust electrical performance.

Compaction Ratio—The compaction ratio (CR) is a measure of the reduction of the core cross sectional area of the constriction prior the crimp connection is formed to after the crimp connection is formed. The compaction ratio equals:

CR=1−(cross section area of crimp connection having bonding process/original cross section area of lead prior to crimp connection).

In accordance with a first embodiment of this invention, referring to FIGS. 1-4, a crimp connection 10 of a lead 12 of an aluminum wire cable, or conductor 14 to a terminal 16 has reduced oxide levels in at least a portion of lead 12 that is attached to terminal 16. Terminal 16 may be formed from copper or copper alloy. Alternately, the terminal may be plated with silver or gold or tin. Crimp connection 10 may also assist to prevent the onset of undesired galvanic corrosion that also may negatively degrade electrical operating performance at crimp connection 10. A bonding process is applied to lead 12 of FIG. 1 prior to lead 12 being inserted in terminal 16 of FIG. 2 to form crimp connection 10 of FIG. 3. The bonding process applied to lead 12 breaks down the oxide or oxide layers that have formed on, or within lead 12.

Figure 2:
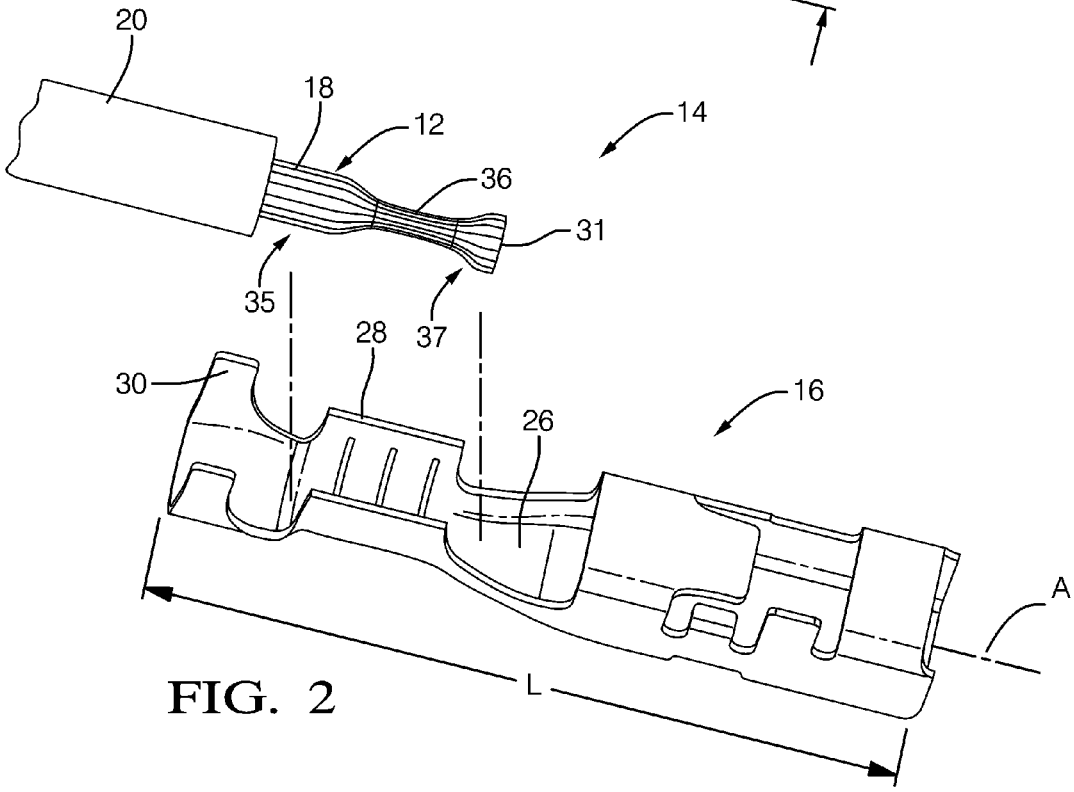
FIG. 2 is an exploded view of the exposed lead of the wire conductor of FIG. 1 that has had a bonding process applied to the lead before being inserted in a terminal in accordance with the invention.

Referring to FIGS. 1 and 2, wire conductor 14 includes an inner metallic wire inner core 18 formed from aluminum or an aluminum-based alloy that is surrounded by an insulation outer layer 20. Insulation outer layer 20 is formed from a dielectric material, such as nylon or plastic-type material. Terminal 16 includes a terminal contact portion 22 and a terminal wire attachment portion 24. A base 26 of terminal 16 communicates with terminal portions 22, 24 along axial length L of terminal 16. Attachment portion 24 includes at least a pair of wings 28, 30 that extend outwardly from base 26. Wire conductor 14 is disposed along, and connects with terminal 16 along a longitudinal axis A. Wings 28, 30 include at least one core wing 28 that is crimped to lead 12 and at least one insulation core wing 30 that is crimped to insulation outer layer 20 adjacent to lead 12 axially remote from a distal end 31 at an end section of lead 12. Contact portion 22 is a female contact portion that may connect with a corresponding mating terminal in another electrical connector of a wiring harness or an electrical component in a vehicle. Alternately, the female contact portion may be a male contact portion, such as a male blade terminal. Metallic wire inner core 18 includes a plurality of individual wire strands 32. As the wire conductors get larger, and hence, have a lower American Wire Gauge (AWG) number, the amount of wire strands in the inner metallic wire core may also generally increase.

Figure 3:
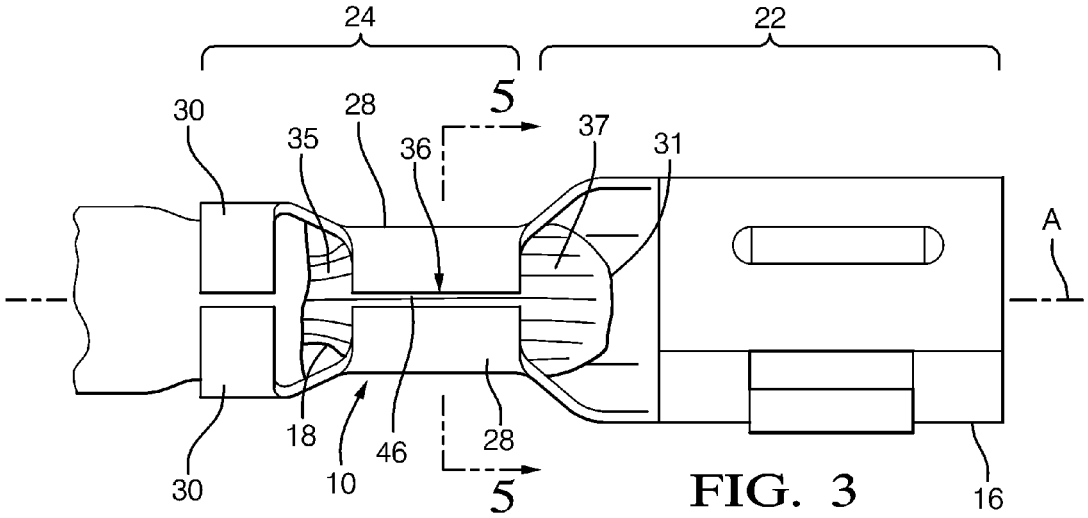
FIG. 3 is a topical view of a crimp connection of the lead and terminal of FIG. 2.

Referring to FIGS. 1-3, a bonding process that includes an ultrasonic weld is applied to lead 12 prior to lead 12 being crimped to terminal 16. Preferably, the ultrasonic weld is performed to only a portion of lead 12 disposed along lead 12 intermediate distal end 31 and outer insulation layer 20 of wire conductor 14, as best illustrated in FIG. 2. The ultrasonic weld may be applied at a 15-20 kilohertz (kHz) frequency. The ultrasonic weld is advantageous to break up oxides on, or in-between wire strands 31 of lead 12. For larger wire conductors having a lead with a larger diameter, oxides are broken-up throughout the lead including the wire strands that are disposed inbound from the outer perimeter of wire strands that encircle the metallic core of the lead.

In one embodiment, at least nineteen (19) individual wire strands form an inner metallic wire core of the wire conductor in which the ultrasonic weld may be effectively employed. With smaller wire conductor sizes having a smaller number of individual wire strands a higher percentage of the wire strands physically make contact with the terminal in the crimp connection. Thus, for smaller wire conductors, the cost benefit of using an ultrasonic weld may be lessened. Alternately, the inner metallic wire core may have any number of wire strands and be formed from other metal materials to employ the ultrasonic weld. After the ultrasonic weld is performed on lead 12, a constriction 36 of lead 12 is formed. Constriction 36 of lead 12 is a solid-like mass of metallic wire conductor formed from individual wire strands 32. Referring to FIG. 1, wire strands 32 are generally straight wire strands disposed in insulation outer layer 20 before the application of the ultrasonic weld. After the application of the ultrasonic weld, constriction 36 is also compacted to have a width that is perpendicular to axis A that is less than a diameter d of metallic wire inner core 18, as best illustrated in FIGS. 1 and 2. Alternately, the wire strands may be twisted wire strands surrounded by the insulation outer core. With wire strands 32 being bonded and combined together by the ultrasonic weld, lead 12 effectively becomes a single unitary wire strand at constriction 36. With constriction 36, individual strands 32 work together as one low resistance wire strand to transfer electrical voltage or current to terminal 16 through crimp connection 10. Constriction 36 approaches a zero resistance connection. The analogy here is the respective individual resistances in constriction 36 add in parallel to generally have an effective resistance of constriction 36 that approaches zero ohms. Thus, electrical current flows in individual wire strands 31 of wire conductor 14 and that are collectively transferred to low resistance constriction 36 and in to terminal 16. Without formation of constriction 36, the inner wire strands in the metallic wire inner core may not transfer energy due to high resistance oxide layer build-up between the wire strands.

After the ultrasonic weld is performed on lead 12, lead 12 includes three sections, moving from left to right, as best seen in FIG. 3. A first section 35 of lead 12 is disposed adjacent to insulation outer layer 20 and includes individual wire strands 32. First section 35 of wire strands 32 transitions to a second section, or constriction 36 of lead 12. Constriction 36 further transitions to a third section 37 of lead 12 which is the forward portion of lead 12 that includes distal end 31. Thus, initially, the individual wire strands 32 are disposed on lead 12 in all three sections 35, 36, 37, as best illustrated in FIG. 1. Third section 37 includes individual wire strands 32 similar to that of first section 35. Preferably, constriction 36 is spaced from insulation outer layer 20. If the ultrasonic weld is applied in first section 35 adjacent to insulation outer layer 20, a quality defect may occur due to possible contamination of insulation outer layer 20 intermingled in the ultrasonic weld. Alternately, any section or the entire lead may experience the ultrasonic weld. First section 35 of individual wire strands 32 also allows for some flexibility in lead 12 which is advantageous when crimp connection 10 is formed, as the aluminum lead may extrude out a small amount during the crimping of lead 12. Wire strands 32 in third section 37 may be cut off before or after the crimp connection is fabricated which simplifies sealing the crimp connection if the crimp connection is further sealed.

Sealing of crimp connection 10 may provide further protection for crimp connection 10 from undesired galvanic corrosion. Sealing of lead 12 that includes constriction 36 with a sealant is preferably performed prior to crimp connection 10 being formed. When the sealed lead 12 including constriction 36 is crimped, the wet sealant coating spreads and penetrates within crimped lead 12 while conforming to the shape of crimp connection 10. Alternately, the crimp connection may be sealed after the crimp connection is formed. A sealant may be applied by a brush or sprayed on to the lead or the crimp connection. For example, one such sealant is conformal coating. The sealant may also be applied to the lead by dipping the lead in the sealant. Still yet alternately, the crimp connection may be sealed with a heat shrink tube that has an inner bonding agent applied to the heat shrink tube. In a further alternate embodiment, an over-mold may be employed to further seal the crimp connection. In yet another alternate embodiment, the crimp connection may have a plurality of sealing provisions. For example, a sealant may be applied to the lead and an over-mold applied over the crimp connection. Oxides that were prevalent on the individual wire strands 32 where constriction 36 is formed are broken-up and fractured after constriction 36 is formed and the ultrasonic weld applied. Constriction 36 is fitted in terminal along axis A laterally adjacent core wings 28. Wings 28, 30 are crimped by a press (not shown) as is typical in the wiring arts to form crimp connection 10, as best illustrated in FIG. 3. Wings 28 surrounding enclose constriction 36. Referring to FIGS. 1 and 2, and as previously described herein, constriction 36 has a width that is less than a diameter d of first section 35 and third section 37.

Crimp connection 10 is not formed when lead 12 is not electrically and mechanically connected to terminal 16. Crimp connection 10 is also not formed if lead 12 does not have the bonding process applied to lead 12.

Figure 4:
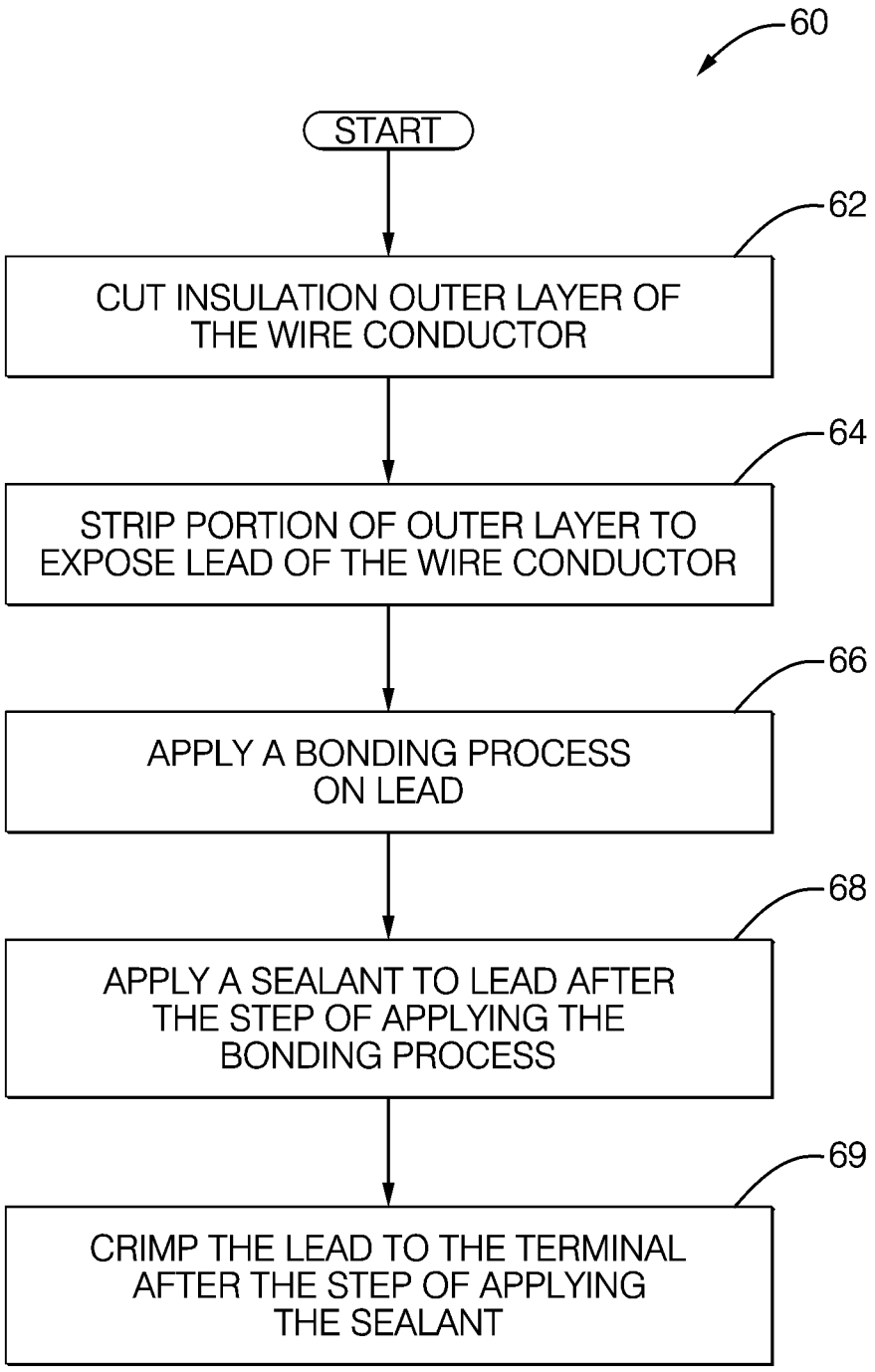
FIG. 4 is a method flow chart to electrically and mechanically connect the lead and the terminal of FIG. 2 to form the crimp connection of FIG. 3.
Figure 5A:
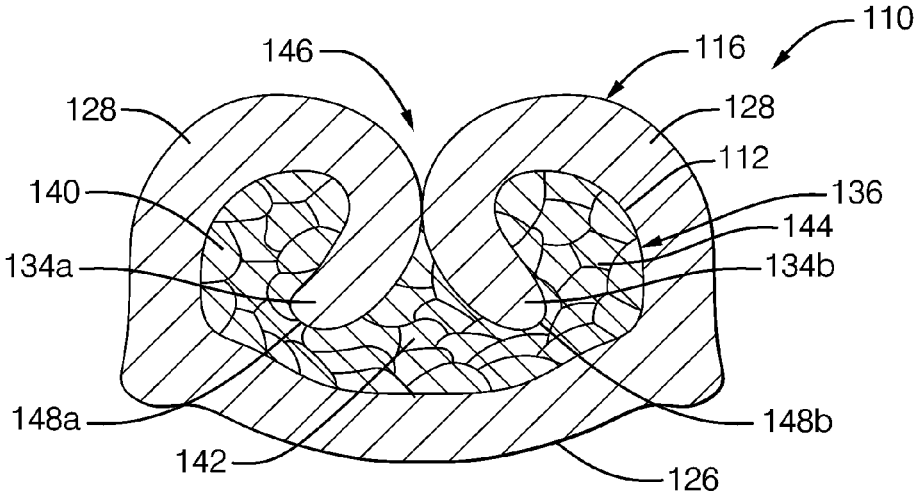
FIG. 5A is a cross section area of the crimp connection of FIG. 3 along the lines 5-5 showing one type of crimp connection and details thereof.
Figure 5B:
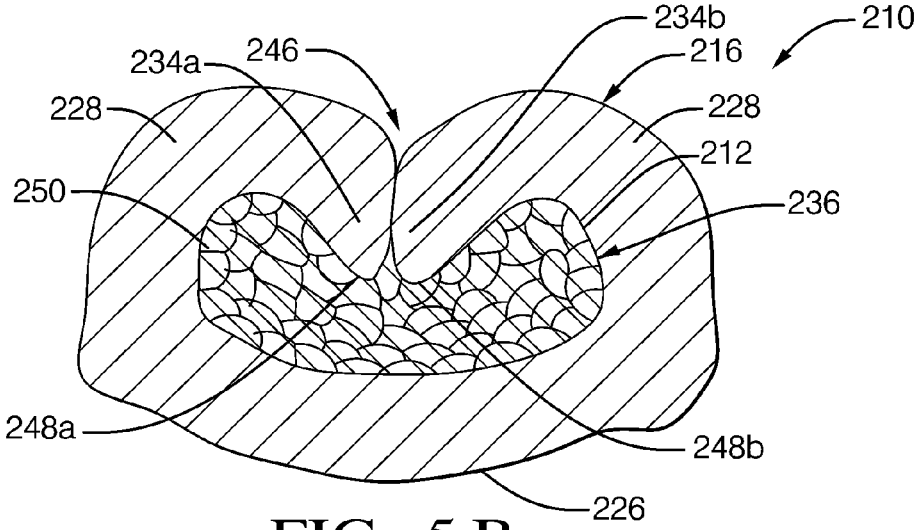
FIG. 5B is a cross section area of the crimp connection of FIG. 3 along the lines of 5-5 showing another type of crimp connection and details thereof.
Figure 5C:
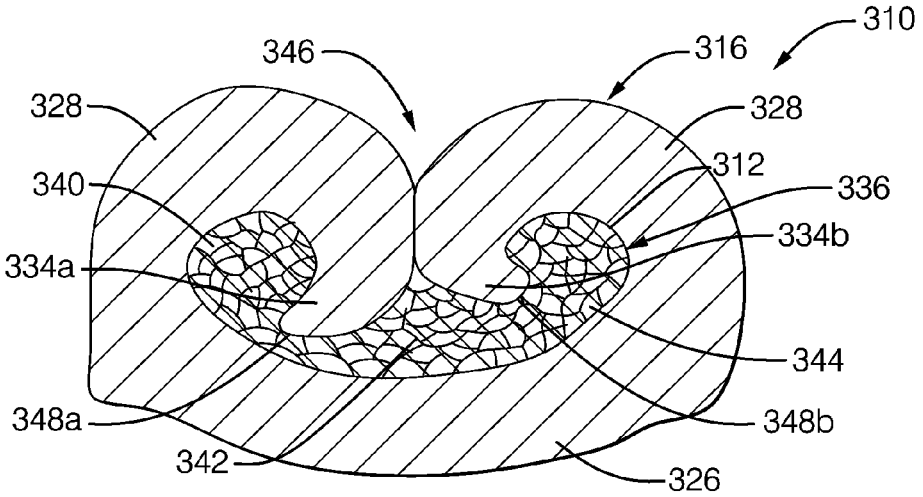
FIG. 5C is a cross section area of the crimp connection of FIG. 3 along the lines of 5-5 showing yet another type of crimp connection and details thereof.

When crimp connection 10 is constructed to attach wire conductor 14 and terminal 16, wire conductor 14 is electrically and mechanically connected to terminal 16. Referring to FIG. 4, crimp connection 10 is fabricated by the steps 62, 64, 66, 68, 69 as shown in method 60. One step 62 in method 60 is cutting insulation outer layer 20 of wire conductor 14 proximate distal end 31 of the wire conductor 14. A further step 64 in method 60 is stripping a portion of insulation outer layer 20 away from wire conductor 14 to expose lead 12, as best illustrated in FIG. 1. Another step 66 in method 60 is applying the ultrasonic weld on lead 12 to form constriction 36, as best illustrated in FIG. 2. Another step 68 in method 60 is applying a sealant on lead 12 after step 66 of applying the ultrasonic weld on lead 12. Yet another step 69 in method 60 is crimping constriction 36 of lead 12 to terminal 16 after step 68 of applying the sealant on lead 12, as best illustrated in FIG. 3. Referring to FIGS. 5A-5C, after constriction 36 is fabricated by the ultrasonic weld and constriction 36 is crimped to terminal 16, crimped lead core wings 28 enclose the crimped constriction 36. Preferably, base 26 of terminal 16 has a concave shape that spans laterally across crimped lead 12 disposed within crimped core wings 28. Crimped lead 12 adjacent to base 26 substantially conforms to the concave shape of base 26. The concave shape of base 26 faces towards respective distal ends of crimped lead core wings 28 within crimp connection 10. Further details of various effective cross sections of crimp connection 10 for different sizes of wire conductors having a different amount of individual wire strands 32 is further described below. Preferably, core wings 28 and insulation core wings 30 are crimped at the same time in the press to provide for an efficient, effective termination of wire conductor 14 and terminal 16.

For different sizes of wire conductor 14, it is preferable to construct an appropriate variation of crimp connection 10 that provides the most effective electrical and mechanical connection for wire conductor 14 where metallic wire inner core 18 has a different amount of individual wire strands 31. FIGS. 5A-5C illustrate a variety of cross section areas of the crimp connection that may be employed to achieve an effective crimp connection where a bonding process has been performed on the lead. The various crimp connections are for wire conductor sizes that generally increase in size moving from FIG. 5A to FIG. 5B to FIG. 5C. In one alternate embodiment of the cross section area of the crimp connection, FIG. 5A shows a cross section area of a crimp connection 110 for the wire conductor where the metallic wire inner core of a lead 112 has at least thirty-seven (37) individual wire strands. Elements in the embodiment of FIG. 5A that are similar to elements in the embodiment of FIG. 1-3 have reference numerals that differ by 100. In another alternate embodiment of the cross section area of the crimp connection, FIG. 5B shows a cross section area of a crimp connection 210 for the wire conductor where the metallic wire inner core of a lead 212 has at least fifty-eight (58) individual wire strands. Elements in the embodiment of FIG. 5B that are similar to elements in the embodiment of FIG. 1-3 have reference numerals that differ by 200. In yet another alternate embodiment of the cross section area of the crimp connection, FIG. 5C shows a cross section of a crimp connection 310 for the wire conductor where the metallic wire inner core of a lead 312 has at least ninety-eight (98) individual wire strands. Elements in the embodiment of FIG. 5C that are similar to elements in the embodiment of FIG. 1-3 have reference numerals that differ by 300.

Referring to FIG. 5A, lead 112 has at least thirty-seven (37) individual wire strands, a cross section area of crimp connection 110 includes a first and a second and a third crimp portion 140, 142, 144. Aluminum constriction 142 being disposed on both sides of the core wings 128, keeps core wings 128 trapped about the constriction 142. Laterally spaced core wings 128 enclose crimp portions 140, 142, 144. Second crimp portion 142 is in adjacent communication with the first crimp portion 140 and third crimp portion 144 is in adjacent communication with second crimp portion 142. A base 126 of a terminal 116 subtends first and second and third crimp portion 140, 142, 144 in a manner so as to have a concave shape that spans across portions 140, 142, 144. The concave shape of base 126 faces crimped core wings 128. One of the crimped core wings 134*a* is formed in a circular shape so as to separate a majority portion of first crimp portion 140 from second crimp portion 142 and to enclose first crimp portion 140 within crimp connection 110. Another one of the core wings 134*b* is formed in a circular shape that generally mirrors the circular shape of the other core wing 134*a* to separate a majority portion of third crimp portion 144 from second crimp portion 142 and enclose third crimp portion 144 within crimp connection 110. Respective core wings 134*a*, 134*b* engagingly communicate with each other along a portion of respective external surfaces of the core wings to form a seam 146 of crimp connection 110. Seam 146 is spaced apart from base 126 and serves to assist in enclosing second crimp portion 142 within crimp connection 110. A portion of a perimeter of crimped constriction 136 has a generally concave shape that conforms to the concave shape of base 126. Distal ends 148*a*, 148*b* of core wings 128 are laterally spaced apart in crimp connection 110. Distal ends 148*a*, 148*b* are also spaced apart from base 126 in crimped constriction 136 in crimp connection 110.

Referring to FIG. 5B, lead 212 preferably has at least fifty-eight (58) individual wire strands. A cross section area of crimp connection 210 includes crimped core wings 228 enclosing a crimped constriction 236 where a base 226 of a terminal 216 has a concave shape that spans across crimped lead 212. In contrast to the crimp portions 140, 142, 144 of the embodiment of FIG. 5A, constriction 236 is generally a single portion 250 that is not generally divided further within crimp connection 210 by crimped core wings 228. Single portion 250 of constriction 236 has a generally concave shape that conforms with the concave shape of base 226. The concave shape of base 226 faces ends 234*a*, 234*b* of crimped core wings 228 of terminal 216. More particularly, base 226 faces a portion of respective distal ends 248*a*, 248*b* of core wings 228. Distal ends 248*a*, 248*b* of crimped core wings 228 touchingly engage along at least portions of respective distal ends 248*a*, 248*b* to form seam 246 of crimp connection 210 that further assists to enclose constriction 236.

Referring to FIG. 5C, lead 312 has at least ninety-eight (98) individual wire strands, a cross section area of crimp connection 310 includes a first and a second and a third crimp portion 340, 342, 344. Second crimp portion 342 adjacently communicates with first crimp portion 340 and third crimp portion 344 is in adjacent communication with second crimp portion 342. A base 326 of a terminal 316 subtends first and second and third crimp portion 340, 342, 344 in a manner so as to have a concave shape that spans across first and second and third crimp portion 340, 342, 344. The concave shape of base 326 faces crimped core wings 328. One of the crimped core wings 328 having an end 334*a* is formed in a circular shape so as to separate a majority portion of first crimp portion 340 from second crimp portion 342 and to enclose first crimp portion 340 within crimp connection 310. Another one of the core wings 328 having end 334*b* is formed in a circular shape that generally mirrors the circular shape of the other core wing 328 having end 334*a* to separate a majority portion of the third crimp portion 344 from second crimp portion 342 and to enclose third crimp portion 344 within crimp connection 310. The respective core wings 328 engagingly communicate with each other along a portion of respective external surfaces of the core wings 328 remote from distal ends 348*a*, 348*b* to form a seam 346 of crimp connection 310. Seam 346 is spaced apart from base 326 perpendicular to axis A and serves to enclose second crimp portion, or constriction 336 within crimp connection 310. Crimped lead 312 has a generally concave shape the mirrors the concave shape of base 326. Crimped lead 312 further includes a depth between base 326 and the one core crimp wing 328 having end 334*a* that is perpendicular to axis A. Crimped lead 312 also has a depth between base 326 and the other crimp wing 328 having end 334*b* that is also perpendicular to axis A. The depth between end 334*b* and base 326 is generally a greater depth than the depth between end 334*a* and base 326. Alternately, any of the crimp connections of FIGS. 5A-5C may be used for other wire conductor sizes having any number of individual wire strands dependent on the electrical application of use.

Figure 6:
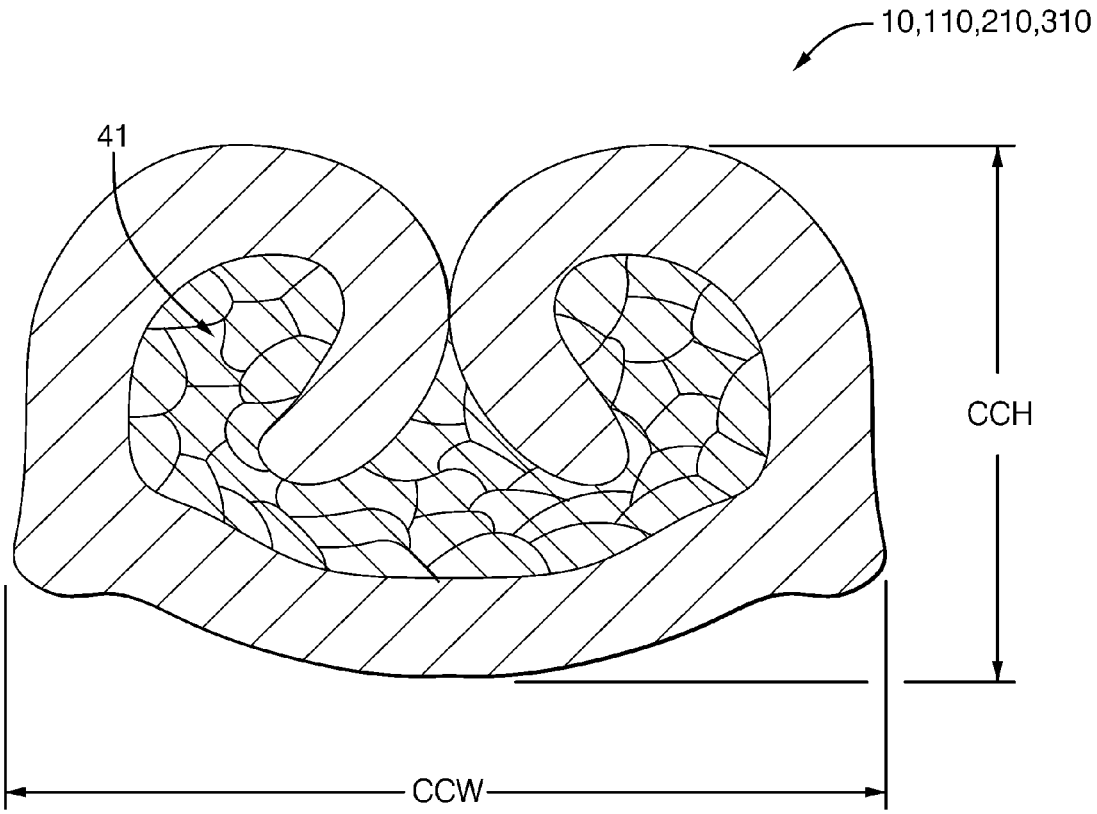
FIG. 6 shows the cross section area of FIG. 5 of the crimp connection of FIG. 3 denoting a crimp core width, a crimp core height, and a compaction ratio.

Referring to FIG. 6, a core crimp width (CCW), a core crimp height (CCH), and the cross section area 41 used in defining the aspect ratio (AR) of any of crimp connections 10, 110, 210, 310 is shown. A sufficient compaction ratio (CR) as measured by the reduction of the inner metallic wire core under pressure of crimping is required to assure good electrical contact between the aluminum lead and the terminal. The level of compaction is largely controlled by the crimp tooling and the CCH. The tooling determines the CCW and the ratio of the CCW to the CCH determines the AR.

Figure 7:
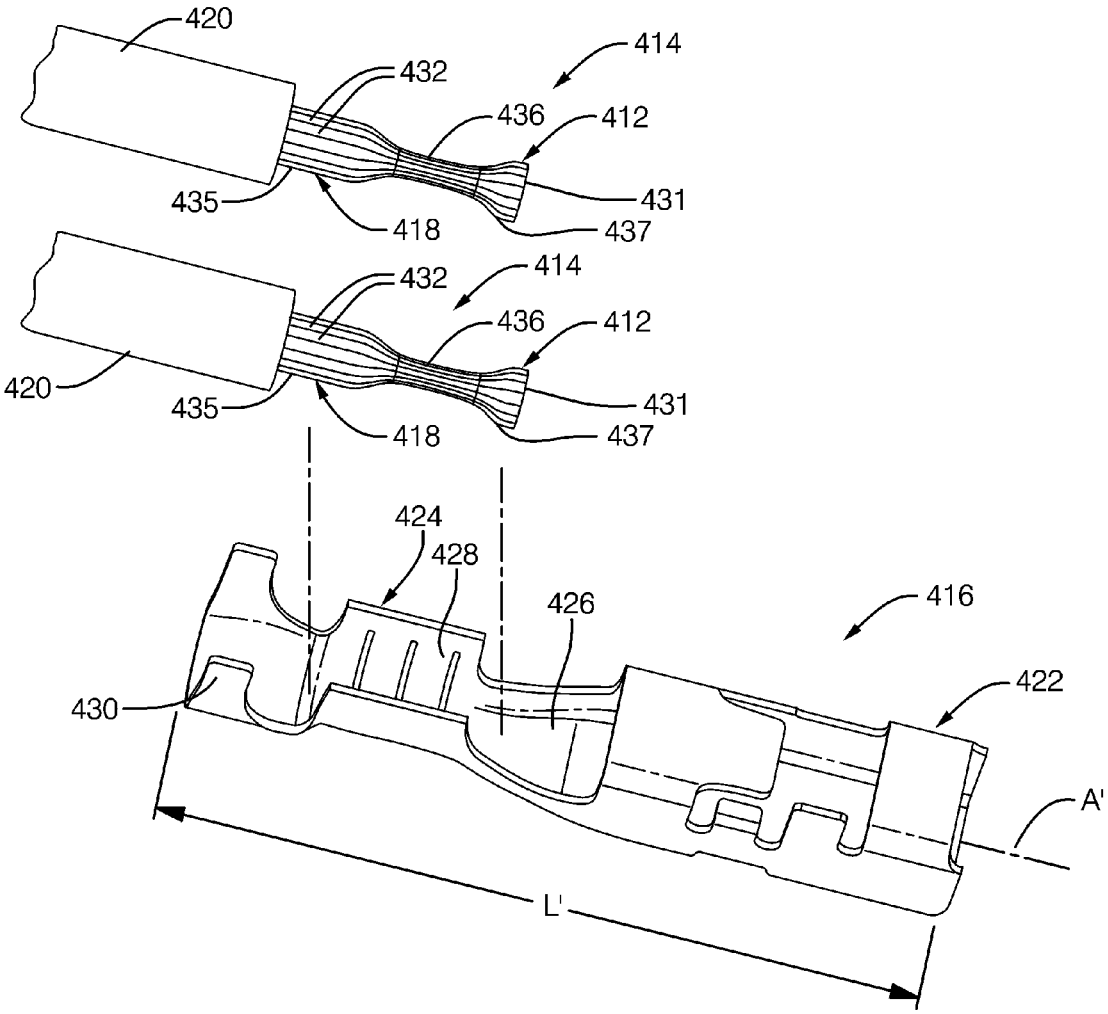
FIG. 7 is an exploded view of two wire conductors where a bonding process has been applied to the respective leads and the leads are inserted in a terminal to form a crimp connection in accordance with an alternate embodiment of the invention.

In an alternate embodiment of the invention, referring to FIG. 7, two wire conductors 414 have respective leads 412 having distal ends 431. Similar elements in the alternate embodiment of FIG. 7 that are similar to the elements in the embodiment of FIG. 1-2 differ by 400. The inner metallic wire core 418 of each lead 412 includes individual wire strands 432. The wire strands 432 of the respective leads 412 are each subjected to the ultrasonic weld. The ultrasonic weld disposed on leads 412 are respectively connected to terminal 416 in the form of a crimp connection (not shown). Terminal 416 has a length L' and a base 426, a contact portion 422, and a wire attachment portion 424. Leads 412 respectively include sections 435, 436, 437 where second section or constriction 436 of each lead 412 is placed along base 426 adjacent to core wings 428 of wire attachment portion 424 of terminal 416 along axis A', that when crimped together, form the crimp connection. Insulation core wings 430 are further crimped to insulation outer layer 420 adjacent to lead 412.

Alternately, the constriction may be disposed along any amount of a length of the lead including all of the lead to ensure a reliable crimp connection.

Alternately, another bonding process may be applying a resistance weld to the lead prior to forming the crimp connection. Still yet alternately, the crimp connection may be formed and then the resistance weld applied to another crimp connection. Another alternate approach may be to apply conductive adhesive to the lead and/or the crimp connection while also employing the resistance weld.

In another alternate embodiment, knurls are disposed on the core wings that are crimped to enclose the constriction. In yet another alternate embodiment, serrations may be employed on the core wings that are crimped to enclose the constriction.

Alternately, the bonding process may be fabricated on a lead that is a single solid inner metallic wire core. Still yet alternately, the bonding process may be incorporated on any wire conductor formed from any material and be of any size.

Alternately, the crimp connection may be used in any application in the motorized transportation industry, or in any product application that requires wire conductors attached to terminals.

Thus, a robust crimp connection that mechanically and electrically connects a lead of at least one wire conductor to a terminal where a bonding process is performed on the lead to break down oxides disposed on the lead prior to the lead being crimped to the terminal has been presented. Using a bonding process, such as an ultrasonic weld, produces a constriction that reduces oxides on the lead for any metallic wire conductor. Formation of the constriction is especially useful for a metallic wire inner core that contains individual wire strands. The constriction fuses and connects the individual strands together to effectively form a single solid-like metallic inner core of the lead. The constriction allows for a reliable electrical connection that is a more reliable electrical conductor for the terminal than the individual wire strands alone if the constriction was not present. The constriction is conveniently formed on the lead prior to construction of the crimp connection between the lead and the terminal. Various cross sections of the crimp connections may be employed to further enhance the electrical connectivity of the lead having the bonding process and the terminal for different sizes of wire conductor.

While this invention has been described in terms of the preferred embodiment thereof, it is not intended to be so limited, but rather only to the extent set forth in the claims that follow.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. A method to electrically and mechanically connect a metallic wire conductor having an inner wire core surrounded by an outer insulation layer to a terminal, the method comprising the steps of:

stripping a portion of the insulation layer from an end section of the wire conductor, thereby exposing a lead of the metallic wire core;

ultrasonically welding the exposed lead to break down oxides disposed on the exposed lead thereby forming a welded lead, wherein a portion of the welded lead is constricted;

removing an unconstricted portion of the welded lead;

followed by the step of applying a wet sealant to the welded lead, thereby forming a sealed lead; and crimping the sealed lead to the terminal to form a crimp connection between the sealed lead and the terminal.

2. The method according to claim 1, wherein the terminal comprises at least one core wing extending from a base of the terminal, and the crimp connection includes the portion of the lead being at least partially enclosed by the at least one core wing.

3. The method according to claim 1, wherein the metallic wire inner core includes a plurality of individual wire strands.

4. The method according to claim 3, wherein the plurality of individual wire strands along a portion of the lead are ultrasonically welded together to form a single unitary wire strand along the portion of the lead during the step of ultrasonically welding the lead.

5. The method according to claim 1, wherein a portion of the lead that is ultrasonically welded is spaced apart from the insulation outer layer and the terminal is crimped to the portion of the lead.

6. The method according to claim 1, wherein the wire conductor is formed of a material selected from the group consisting of, (i) an aluminum material, and (ii) an aluminum alloy material.

7. The method according to claim 1, wherein the step of crimping the sealed ultrasonically welded lead to the terminal is performed while the sealant is still wet.

8. The method according to claim 1, wherein the wet sealant is applied by brushing, spraying, or dipping.

* * * * *